United States Patent [19]

Okumura

[11] Patent Number: 4,569,323

[45] Date of Patent: Feb. 11, 1986

[54] OIL SEPARATOR

[75] Inventor: Shuji Okumura, Obu, Japan

[73] Assignee: Aisin Seiki Kabushiki Kaisha, Kariya, Japan

[21] Appl. No.: 631,174

[22] Filed: Jul. 16, 1984

[30] Foreign Application Priority Data

Jul. 25, 1983 [JP] Japan ..... 58-115419[U]
Aug. 3, 1983 [JP] Japan ..... 58-121514[U]

[51] Int. Cl.[4] ..... F01M 13/00; F02F 9/00

[52] U.S. Cl. ..... 123/572; 123/573; 123/41.8 C

[58] Field of Search ..... 123/572, 573, 574, 41.86

[56] References Cited

U.S. PATENT DOCUMENTS

| | | | |
|---|---|---|---|
| 1,323,048 | 11/1919 | Goodwin | 123/572 |
| 1,372,939 | 3/1921 | Coleman | 123/572 |
| 2,354,722 | 8/1944 | Walton | 123/573 |
| 2,493,617 | 1/1950 | Chubbuck | 123/573 |
| 3,340,859 | 9/1967 | Williamson | 123/572 |
| 3,875,916 | 4/1975 | Patton | 123/573 |
| 3,949,719 | 4/1976 | Bellanca | 123/573 |
| 4,102,314 | 7/1978 | Sarto | 123/572 |
| 4,103,650 | 8/1978 | Nishida | 123/572 |

*Primary Examiner*—Ronald H. Lazarus
*Attorney, Agent, or Firm*—Oblon, Fisher, Spivak, McClelland & Maier

[57] ABSTRACT

An oil separator mounted on a cylinder head cover of an internal combustion engine to separate the lubricating oils within the blowby gases includes a buffer to intercept splashes of oil within the cylinder head cover, an inclined porous filter of foaming metal material positioned downstream of the buffer and an oil reservoir for depositing of the oil trapped by the filter.

5 Claims, 3 Drawing Figures

OIL SEPARATOR

BACKGROUND OF THE INVENTION

1. Field of the Invention

This invention relates to oil separators and more particularly to an oil separator to separate lubricating oils in blowby gases which are generated within a vehicle internal combustion engine.

2. Discussion of the Background

It is known that during compression and explosion strokes of the internal combustion engine, the bloody gases which blow through a crankcase from a gap between a piston and a cylinder containing lublicating oils for a cam shaft and the like. A prior oil separator which is positioned on a head cover of the cylinder to separate such lubricating oils has a downward rectification plate to prevent lubricating oils from being brought into the separator along the flow of the blowby gases and a divider plate having a plurality of small holes to separate lubricating oils in the blowby gases. Another prior oil separator has a zigzag passage between inlet and outlets to separate lubricating oil in the blowby gases.

In such prior oil separators, however, the suspended oils in a state of vapor pass through the divider plate or the zigzag passage and therefore such oils may not be separated completely.

SUMMARY OF THE INVENTION

It is, therefore, an object of the present invention to provide a new and improved oil separator which obviates the above mentioned prior drawbacks.

It is another object of the present invention to provide a new and improved oil separator which has a high oil separation capability.

It is still another object of the present invention to provide a new and improved oil separator which is simple in construction.

In accordance with the present invention, an oil separator is provided which includes a case mounted on a cylinder head cover, buffer means positioned near the inlet port and within the case to intercept splashes of the lubricating oils within the cylinder head cover, an inclined porous filter of foaming metal material positioned downstream of the buffer means, and an oil reservoir positioned at the lower end of the filter to reserve the oils trapped by the filter.

BRIEF DESCRIPTION OF THE DRAWINGS

Various other features, objects and attendant advantages of the present invention will be more fully appreciated as the same becomes better understood from the following detailed description when considered in connection with the accompanying drawings wherein.

DESCRIPTION OF THE PREFERRED EMBODIMENTS

Figure 1:
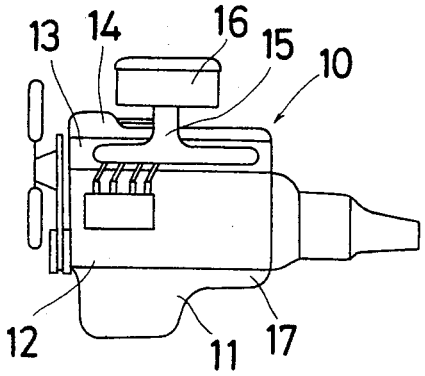
FIG. 1 is a side view of an internal combustion engine in which an oil separator according to the present invention is applied.

A four-cylinder engine 10 which is shown in FIG. 1 has an oil pan 11, a crankcase 17, a cylinder block 12, a cylinder head 13, a cylinder head cover 14 and a carburetor having an air suction passage 15 connected to an air filter 16.

Figure 2:
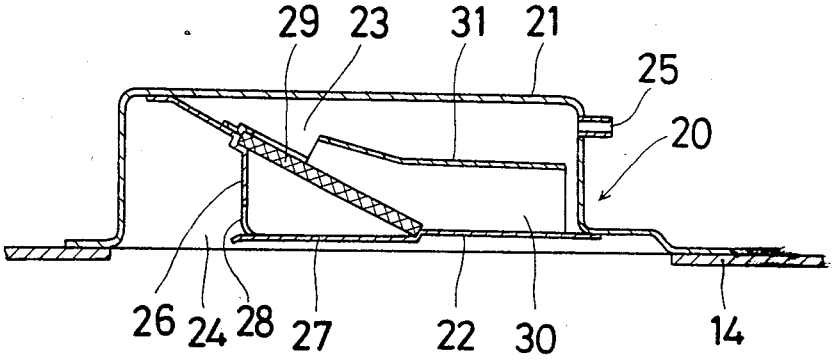
FIG. 2 is a cross sectional view of the oil separator according to the present invention.

In FIG. 2, an oil separator 20 according to the present invention is mounted on the cylinder head cover 14 to cover a chamber which is defined by the cylinder head 13. The oil separator 20 has a case 21 secured to the cylinder head cover 14. Securely mounted on the case 21 is a buffer means which has a bottom plate 22 secured to a lower open portion of the case 21 to thereby define a chamber 23 therein. The plate 22 has at the left end portion thereof an inlet 24 which receives the blowby gases while the case 21 has at the right wall portion thereof an outlet port 25 for the blowby gases. The outlet port 25 is brought in communication with the air cleaner by means of a hose (not shown). The buffer means also has a first buffer 2 which is secured to the case 21 and extends from ceiling of the case 21. The first buffer 26 is arranged so as to be inclined rightwardly. The lower portion of the buffer 26 extends vertically. The left portion 27 of the bottom plate 22 acts as second buffer. Thus, the splashes of the lubricating oils which prevail within the cylinder head cover 14 and flow into by means of the inlet port 24 are firstly intercepted by the buffer means. A space 28 is formed by the first and second buffers 26 and 27 of the buffer means and the blowby gases which flow into from the inlet port 24 flow out by means of the outlet port 25.

A porous filter 29 of foaming metal material is mounted on the upper surfaces of the buffers 26 and 27 downstream of the buffers in the direction of flow of the bypass gases and is inclined by 14°~90° with respect to a horizontal plane of the cylinder head cover 14. An oil reservoir 30 is formed at the lower side of the filter 29 and at the downstream of the filter 29. Since the filter 29 is formed of porous foaming metal material which has a high efficiency to trap the oil mists, the speed of flow of the blowby gases which pass through the space 28 is reduced by means of the arrangement of the filter 29. The component of the oil which is contained in the blowby gases forms a ball-like state. Such oils of a ball-like state drop due to gravity since the filter 29 is arranged so as to be inclined. During the operation of the engine, the oils which are trappd by the filter 29 drop and are temporarily contained in the oil reservoir 30. Such contained oils pass through the lower portion of the filter 29 and are then returned to the engine by means of the inlet port 24 when operation of the engine is stopped. As is clear from the foregoing discussion, the component of the oil contained in the blowby gases is removed especially at the upper portion of the filter 29 so that the air passage is preserved. Thus, the blowby gases from which the component of the oil is removed flow to the outlet port 25. A third buffer 31 which is positioned over the oil reservoir 30 to intercept splashes of the lubricating oil which may be trapped by means of the filter 29. The third buffer 31 is connected with the buffer means 22 to thereby support the filter 29 therebetween and to thereby define the reservoir 30.

Figure 3:
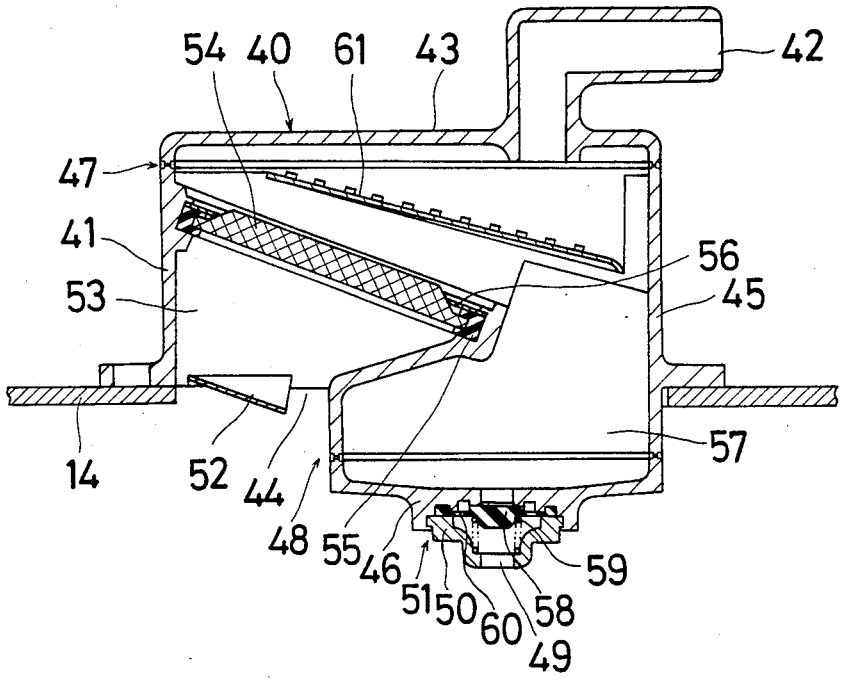
FIG. 3 is a view similar to FIG. 2, but showing a modification of the present invention.

Referring now to FIG. 3 showing a modification of the present invention, an oil separator 40 has a case 41 secured to the cylinder head cover 14. The case 41 has a first body 43 having an outlet port 42 for blowby gases, a second body 45 having an inlet port 44 which is open to a chamber defined by the cylinder head cover 14, and a third body 46, these bodies 43, 45 and 46 being deposited at 47 and 48 by welding. A fourth body 50 which has an oil return hole 49 is secured to the lower portion of the third body 46 by connection 51 by ultrasonic welding.

A buffer 52 which is secured to the body 45 so as to be position at the inlet port 44 intercepts splashes of the lubricating oils within the cylinder head cover 14. A filter 54 of porous foaming metal material which is substantial the same as that of the previous embodiment is positioned with a preset space 53 at a position downstream of the buffer 52. This filter 54 is also inclined by 15°~90°. The outer periphery of the filter 54 is supported by a seal member 55 of rubber material the entire circumference of which is fitted to the second body 45 by means of a plate 56. An oil reservoir 57 which is positioned at the side of the lower end of the filter 54 is defined by the second and third bodies 45 and 46 and receives the oil which flows out from the filter 54. A check valve 58 is positioned between the oil reservoir 57 and the port 49 and the outer periphery of the check valve 58 is inserted between the third and fourth bodies 46 and 50. The check valve 58 is continuously biased in towards a closed position by means of a spring 59. When the check valve 58 is opened, a hole 60 which is formed in the check valve 58 completes a fluid communication between the reservoir 57 and the port 49 to thereby allow only the flow of fluid from the reservoir 57 to the port 49. A buffer 61 which is pressed to the body 45 so as to be positioned downstream of the filter 54 functions so as to cause to block the oils which pass through the filter 54. The blowby gases can pass around the circumference of the buffer 61.

In this modification, the lubricating oils within the cylinder head cover 14 are firstly intercepted by means of the buffer 52 and the speed of the flow of blowby gases which flow into the space 53 through means of the inlet port 44 decreases. The component of the oil within the blowby gases, the speed of flow of which is decreased, is separated and trapped by means of the filter 54 during the passage of blowby gases through the filter 54. Since the filter 54 is positioned so as to be inclined by 15°~90°, the oils which are trapped by the filter 54 moves downwardly due to the force of gravity and then drop into the reservoir 57. When the component of the oil passes through the filter 54, such oil is caused to be dropped into the reservoir 54 by means of the buffer 61. The blowby gases in which the component of the oil is separated lead to the outlet port 42 and are then returned to the suction system of the engine.

During operation of the engine, the oils are kept in the reservoir 57 since the check valve 58 is forced to its closed position by means of the fluid pressure within the crankcase which is in communication with the cylinder head. When the operation of the engine stops, the fluid pressure within the crankcase disappears and then the check valve 58 is opened by the gravitation of the oils per se. Thus, the oils are transmitted to the crankcase through means of the holes 60 and 49.

By the foregoing, there has been disclosed preferred forms of the oil separators constructed in accordance with the present invention. It will be appreciated that various additions, substitutions, modifications and omissions may be made thereto without departing from the spirit of the invention.

What is claimed is:

1. In an internal combustion engine including a cylinder head and a cover for each cylinder wherein the improvement comprises an oil separator having inlet and outlet ports and which is mounted on said cylinder head cover to separate and trap the lubricating oils within the blowby gases and which further comprises:

a case mounted on said cylinder head cover, buffer means positioned near said inlet port and within said case to intercept splashes of the lubricating oils within said cylinder head cover, an inclined porous filter of foaming metal material inclined at an angle of 15°-90° with respect to a horizontal plane of said cylinder head case and positioned downstream of said buffer means in a direction of flow of said blowby gases, and an oil reservoir positioned at the lower end of said filter to reserve the oils trapped by said filter wherein said buffer means further comprises a first buffer having a first inclined buffer secured to said case so as to extend from the ceiling of said case and a second buffer formed on a bottom plate which is secured to a lower open portion of said case; and a second buffer positioned downstream of said filter and above said oil reservoir.

2. An oil separator as set forth in claim 1, further comprising a check valve to return the oils within said reservoir to an interior portion of the engine.

3. An oil separator as set forth in claim 2, wherein said check valve is positioned at a lower portion of said case defining said reservoir.

4. An oil separator as set forth in claim 1, wherein said filter is mounted on said first and second buffer.

5. An oil separator as set forth in claim 1, wherein said filter is mounted on said case.

* * * * *